United States Patent [19]

Kaye

[11] Patent Number: 4,706,321

[45] Date of Patent: Nov. 17, 1987

[54] DRAIN-CLEANING IMPLEMENT

[75] Inventor: Paul S. Kaye, Racine, Wis.

[73] Assignee: Lewisan Products, Inc., Racine, Wis.

[21] Appl. No.: 915,625

[22] Filed: Oct. 6, 1986

[51] Int. Cl.[4] ..... B08B 9/02

[52] U.S. Cl. ..... 15/104.3 SN; 242/96

[58] Field of Search ..... 15/104.3 SN; 254/134.3 FT; 242/54 R, 96

[56] References Cited

U.S. PATENT DOCUMENTS 2,130,635 9/1938 Dow et al. ..... 15/397

4,340,988 7/1982 Shames et al. ..... 15/104.3 SN

FOREIGN PATENT DOCUMENTS 157296 12/1903 Fed. Rep. of Germany ..... 15/104.3 SN

*Primary Examiner*—Edward L. Roberts

*Attorney, Agent, or Firm*—Peter N. Ltd. Jansson

[57] ABSTRACT

A drain-cleaning implement having a plastic shell of two subshells snapped together using male and female mating means along abutting edges and having a snake coiled within the shell and exerting outward mating force on it. The male means are on projections extending from inwardly-projecting sidewall portions formed at intervals around the inside surface of one subshell, and such inside surface has substantially edge-free transitions between the inwardly-projecting portions and positions therebetween to strengthen the shell with maximum mating force from the snake. Preferred embodiments have corner-free mating means. A stop ledge facilitates proper mounting of a rotatable handle.

18 Claims, 10 Drawing Figures

DRAIN-CLEANING IMPLEMENT

FIELD OF THE INVENTION

This invention relates generally to snake implements for cleaning drains, and, more particularly, to drain-cleaning implements of the type having plastic shells formed of two subshells which are snapped together.

BACKGROUND OF THE INVENTION

A wide variety of implements using coils of coil-wire snakes have been developed over the years in order to facilitate the cleaning of drain pipes and the like. A number of such implements have included a generally cylindrical cannister which contains the coiled snake, means to remove one end of the snake to whatever extent is necessary for insertion into the clogged pipe or the like, and some means for turning the cannister in order to turn the snake for drain-cleaning purposes. Some of such cannisters are plastic shells which are formed of two subshells secured together in various ways.

While spin welding or ultrasonic welding and other plastic-sealing techniques have been used for this purpose, in some cases the subshells have been snap-fit together using a plurality of pairs of male-female snap means along abutting annular edges of the two subshells. While this has certain advantages in ease of original assembly, such products do have certain problems and shortcomings.

For example, the plastic subshells having such mating means formed therein have been somewhat susceptible to breakage by virtue of the edges and corners which have been characteristic of such structural features in such products. When such drain-cleaning implements are dropped, breakage can frequently occur along such edge lines and corner lines.

Another problem relates to the need to achieve proper snap engagement of such subshells. This problem requires a somewhat lengthy explanation.

Such plastic subshells frequently do not come out of the mold in true round condition. That is, the annular edges of such subshells, which are to abut each other when such subshells form a complete shell, frequently are not true round prior to and at the time such subshells are assembled together. Therefore, the male and female mating means on such subshells often do not engage each other as fully as is desired. It is helpful that the coiled snake inside an assembled shell exert some outward force on the shell to bring it closer to true round, and thus assist in full mating of the subshells.

In certain structures of the prior art, the inside surface of one of the subshells has had inwardly-projecting sidewall portions (or built-up portions) formed at intervals around the inside surface of the cylindrical subshell wall in order to accommodate the male mating means used for snap engagement of the two subshells. More specifically, such inwardly projecting sidewall portions extend beyond the abutting edge of the subshell (on which they are formed) as projections with outwardly-facing male means thereon to engage female means on the other subshell. Such inwardly-projecting sidewall portions formed at intervals around the inside surface of the subshell have provided good pressure points for the coiled snake within the plastic shell, and have allowed application of relatively effective outward pressure by the coiled snake at positions near the male mating means. This has encouraged proper and full engagement of the pairs of mating means fairly well.

However it is such inwardly-projecting sidewall portions that have produced the aforementioned significant edges across the cylindrical walls of the subshell and provide lines of weakness increasing the likelihood of breakage upon dropping or other rough handling. Mere thickening of the subshell walls, while providing strengthening through elimination of edge lines, would remove the advantage of effective pressure points for application of outward force by the coiled snake to assist in full engagement of the mating means and in making the plastic shell round. Thus, the normal solution for one problem leads to another problem, the loss of a most effective engagement assist which could be provided by the coiled snake.

Another problem with such prior plastic shells used for drain-cleaning implements in the prior art relates to improper relative rotation of the handle which, on such products, is rotatably mounted on a stem or other mounting means extending from tne plastic shell. Such handles, which are normally gripped in one hand while the plastic shell and the snake are turned by the other, are often improperly mounted on the stem because of improper positioning of a clamp ring on such stem. Such clamp ring is used to hold the handle in place and also to clamp the snake to the stem when the proper length of such snake has been pulled from the plastic shell for use.

Such improper positioning can cause the handle to bind on the stem, so that the two parts do not rotate properly with respect to each other, or can cause the handle to be too wobbly.

There is a need for significant improvement in the plastic shell to overcome the aforementioned disadvantage and problems.

OBJECTS OF THE INVENTION

It is an object of this invention to provide an improved drain-cleaning implement of the type having a plastic shell formed of two subshells snapped together.

Another object of this invention is to provide a drain-cleaning implement with a plastic shell which is less susceptible to breakage by dropping.

Another object of this invention is to provide a plastic shell having improved structural strength and which has snap-engageable subshells the engagement of which is effectively assisted by the uncoiling force of the coiled snake therein.

Another object of this invention is to provide a drain-cleaning implement of the type having a plastic shell with proper dimensioning for proper rotational engagement and operation of its handle.

These and other important objects will be apparent from the descriptions of tnis invention which follow.

SUMMARY OF THE INVENTION

This invention is an improved drain-cleaning implement of the type described overcoming some of the problems of the prior art, including those mentioned above.

More specifically, this invention is an improvement in drain-cleaning implements of the type having: a plastic shell with two endwalls and a cylindrical sidewall and formed by two subshells with abutting annular edges around the sidewall; an axial opening in one endwall; mounting means and a rotatably-mounted handle thereon extending from the one endwall at the opening;

a snake coiled within the shell exerting radial force on the inside surface of the sidewall and having a distal end extending through the opening and handle; female mating means in one subshell; and a plurality of inwardly-projecting sidewall portions formed at intervals around the inside surface on the other subshell and extending beyond the abutting edges as projections having outwardly-facing male means positioned thereon to engage the female means and hold the subshells together.

In the drain-cleaning implement of this invention, the inside surface of the subshell which has the plurality of inwardly-projecting sidewall portions presents a substantially edge-free surface around such subshell, with smooth transitions from longer-radius positions between the inwardly-projecting sidewall portions to shorter-radius positions on the inwardly-projecting sidewall portions. This smooth-walled configuration allows effective application of outward pressure on the subshell by the coiled snake, while at the same time eliminating the structural weaknesses which are caused by sharp corners and edge lines.

In the most preferred embodiments, the inwardly-projecting sidewall portions have progressively shorter radii a positions progressively closer to their centers (that is, the centers of the arcs along which they extend). This allows the application of maximum outward force on the subshell by the coiled snake to more effectively assist in causing full engagement of the mating means and in making the shell round.

The centers of the inwardly-projecting sidewall portions are preferably aligned with the centers of the male mating means and corresponding female mating means. And, since outward force is applied directly on the center lines of the inwardly-projecting sidewall portions, maximum assistance is provided by the coiled snake in obtaining full engagement of the snap means which join the subshells together.

In certain preferred embodiments, the inside surface of the subshell which includes the inwardly projecting sidewall portions may be described as having a smoothly undulating annular profile extending alternately from a first radius at positions between the inwardly-projecting sidewall portions gradually to shorter radii at positions on the inwardly-projecting sidewall portions. In some embodiments, the inwardly-projecting sidewall portions have center portions of considerable width at a fixed shorter radius.

There are preferably at least three inwardly-projecting sidewall portions, and in some cases, four or more. For each inwardly-projecting sidewall portion, there is a pair of male and female mating snap members.

Highly preferred embodiments of the drain-cleaning implement of this invention have female mating means which are slots extending a given distance around the plastic shell with corner-free profiles, in order to minimize other points of structural weakness in the plastic subshell. The male mating means preferably have corner-free configurations to correspond to the corner-free profiles of the female slots.

Another feature of certain preferred embodiments of this invention relates to the rotatably-mounted handle and the means on which it is mounted. In such embodiments, the mounting means is an axial stem which has a proximal end secured to the endwall around the opening and extending to a distal end, the stem having a reduced diameter portion at the distal end to form a stop ledge near the distal end.

The handle is rotatably mounted on the stem at a position between the proximal end and the stop ledge, and the snake extends through the stem to a position beyond the stem distal end. A clamp ring extends over the distal end and against the stop ledge and includes means, such as a thumbscrew means, to selectively engage the stem and the snake. The clamp ring and thumbscrew are used in the prior art, but preferred embodiments of this invention provide such stop ledge. This gives positive positioning of the clamp ring so that the handles on such products will be made to rotate properly, without either binding or being too loose, without special attention during assembly.

DETAILED DESCRIPTION OF PREFERRED EMBODIMENTS

Figure 1:
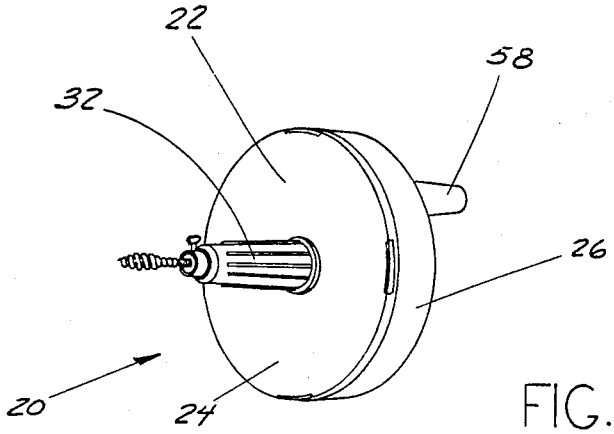
FIG. 1 is a perspective view of a preferred drain-cleaning implement in accordance with this invention.
Figure 2:
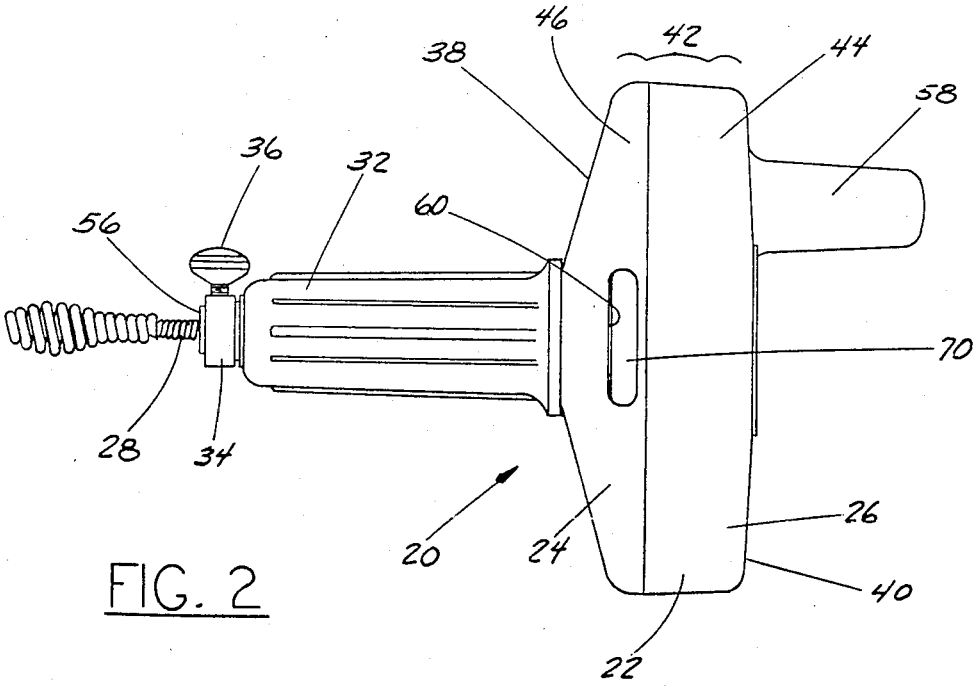
FIG. 2 is an enlarged side elevation of FIG. 1.
Figure 3:
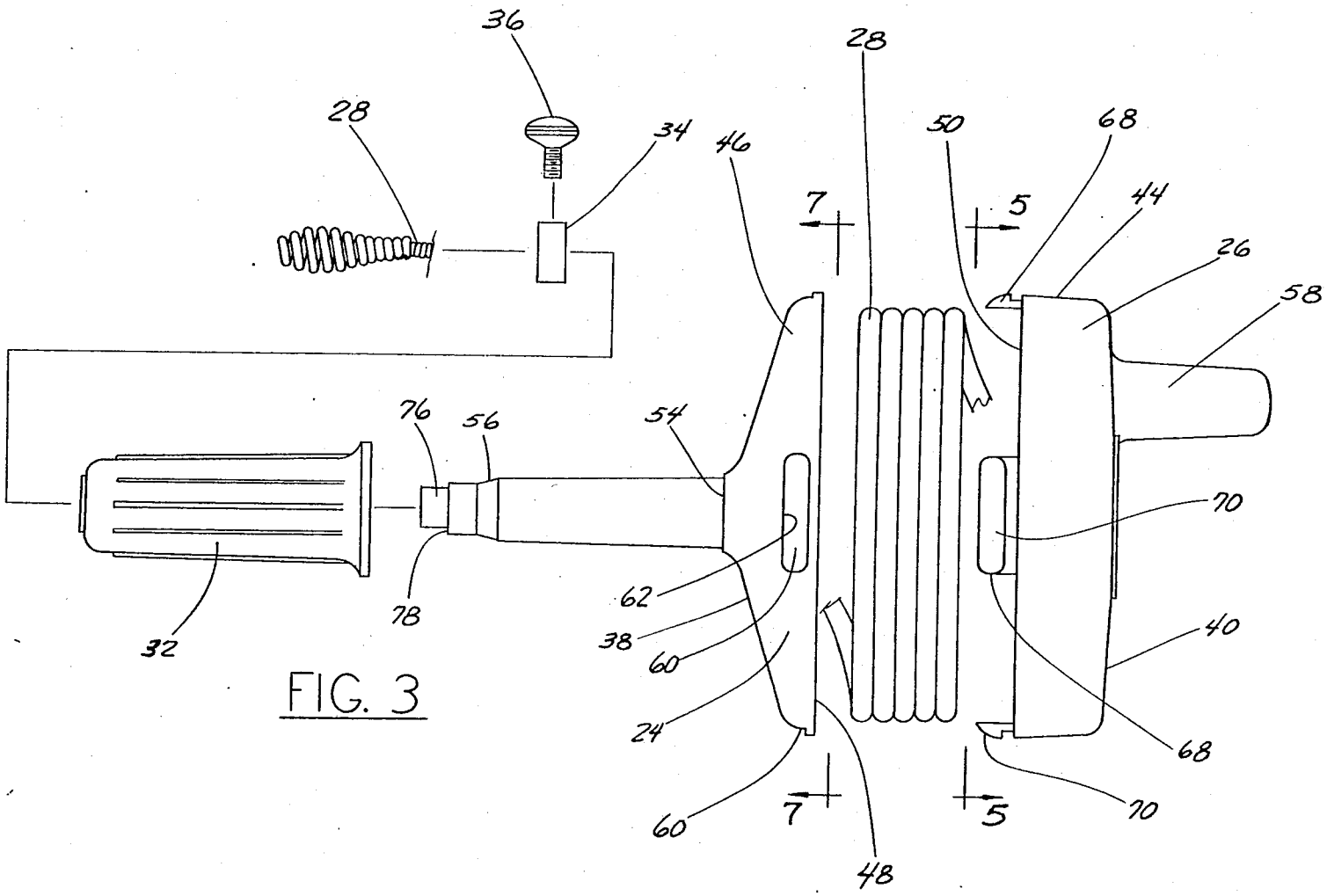
FIG. 3 is an exploded side elevation.
Figure 7:
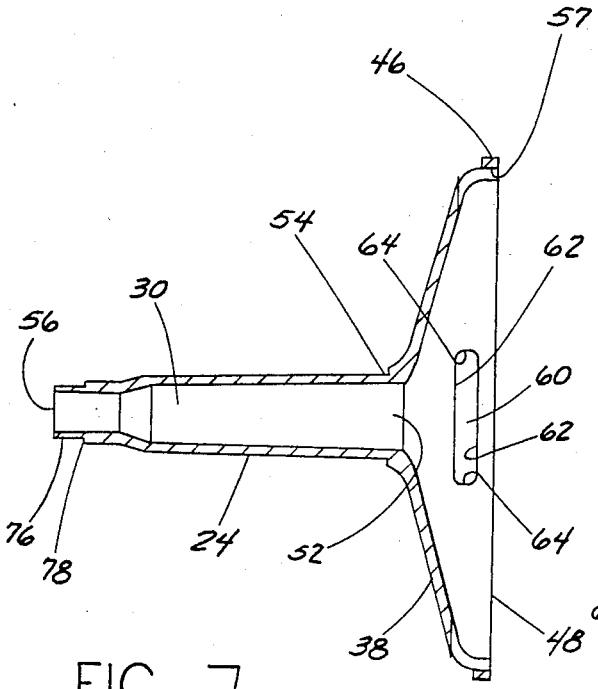
FIG. 7 is another sectional view of such other subshell, taken along section 7—7 as indicated in FIG. 6.
Figure 6:
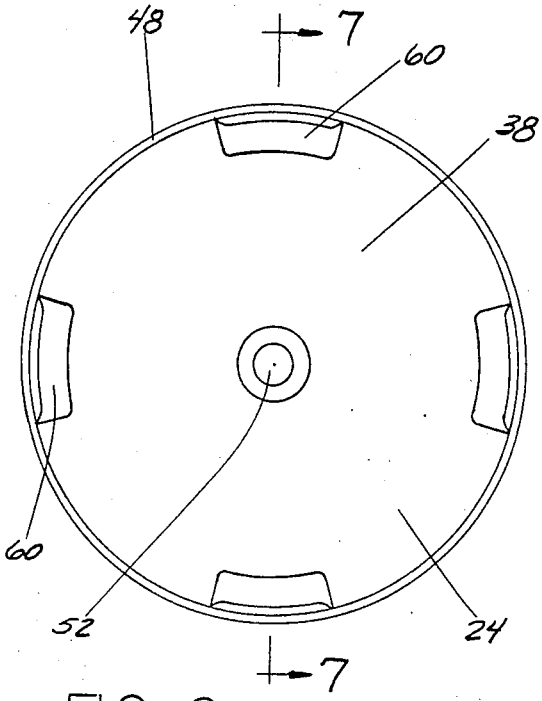
FIG. 6 is a sectional view of the other subshell, taken along section 6—6 as indicated in FIG. 3.
Figure 5:
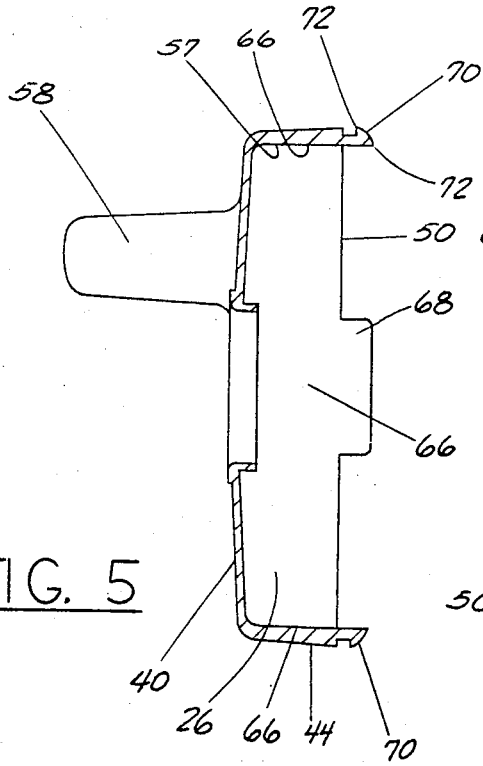
FIG. 5 is another sectional view of the same subshell, taken along section 5—5 as indicated in FIG. 4.
Figure 4:
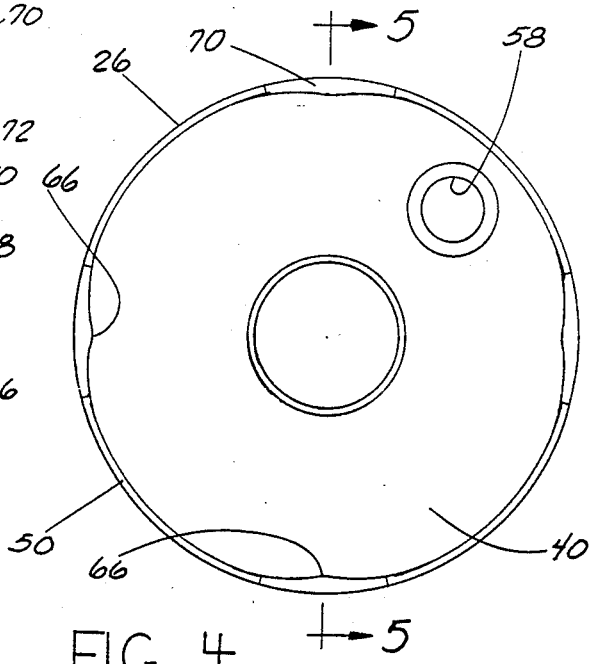
FIG. 4 is a sectional view of one subshell, taken along section 4—4 as indicated in FIG. 3.
Figure 8:
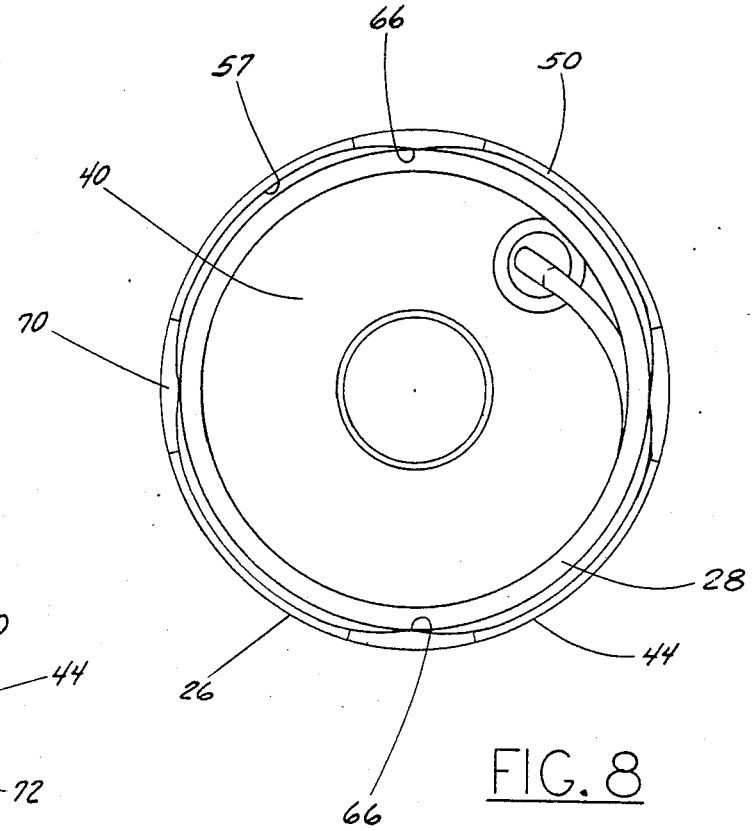
FIG. 8 is a sectional view taken along section 8—8 as indicated in FIG. 2.
Figure 9:
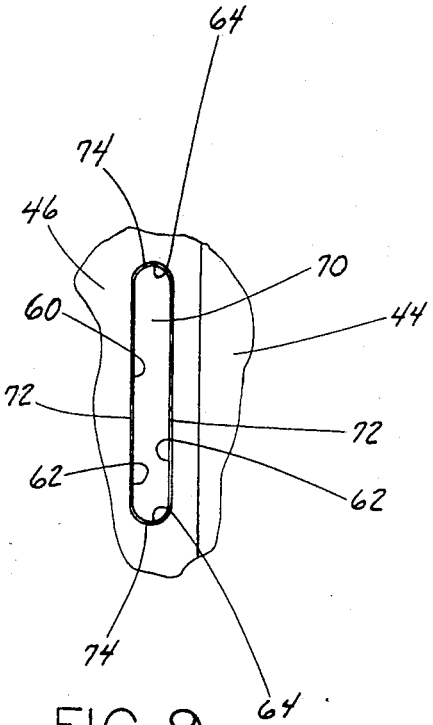
FIG. 9 is an enlarged fragmentary view of FIG. 2, illustrating tne configuration of the mating snap means.
Figure 10:
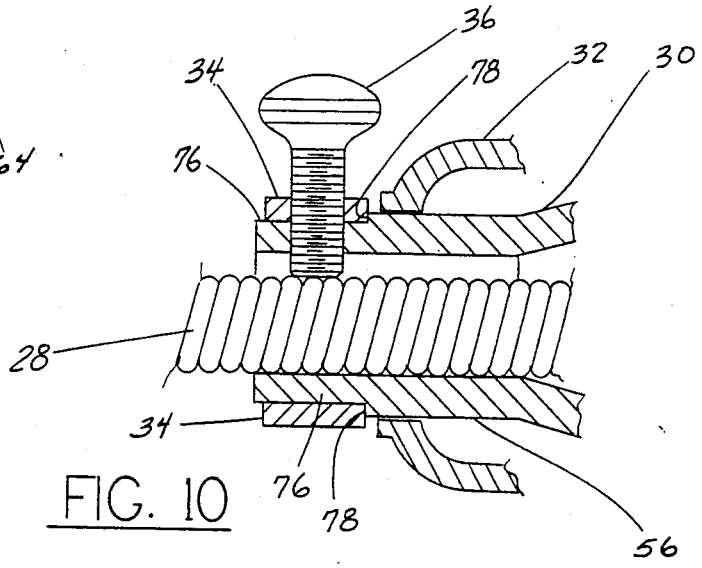
FIG. 10 is another enlarged fragmentary sectional view of FIG. 2, illustrating the configuration of parts at the distal end or the stem, changed, however, such that the snake is drawn out to some extent and locked in place.

The figures illustrate drain-cleaning implement 20 in accordance with this invention. Drain-cleaning implement 20 includes a plastic shell 22 made from two plastic subshells 24 and 26, a flexible coil-wire snake 28 which is coiled within plastic shell 22, a stem 30 protruding axially from plastic subshell 24 and having one end of snake 28 extending therethrough, a handle 32 mounted on stem 30, and a clamp ring 34 attached to stem 30 by a thumbscrew 36 and securing snake 28 to stem 30.

Plastic shell 22 has first and second endwalls 38 and 40 which are parts of subshells 24 and 26, respectively, and a cylindrical sidewall 42. A major portion 44 of sidewall 42 is part of plastic subshell 26, being integrally formed with second endwall 40, and a minor portion 46 of sidewall 42 is a part of plastic subshell 24, being integrally formed with first endwall 38. Subshells 24 and 26 have abutting annular edges 48 and 50, respectively, extending around cylindrical sidewall 42.

Plastic subshell 24 has an axial opening 52 about which the proximal end 54 of stem 30 is secured, stem 30 and plastic subshell 24 being integrally formed. Stem 30 extends from proximal end 54 to a distal end 56. Handle 32 is concentrically and rotatably mounted on stem 30.

Snake 28 is coiled within plastic shell 22 and exerts outward radial force on the inside surface 57 of cylindrical sidewall 42 by virtue of its natural tendency to uncoil. Snake 28, while coiled of necessity when it is contained within shell 22, will quickly take on a generally straight orientation as soon as it is, and to the extent that it is, removed from shell 22, which normally occurs by pulling snake 28 through stem 30. Snake 28 is itself a length of very tightly coiled wire, as is well known in the art.

In operation, a length of snake 28 is pulled out of shell 22 through stem 30. Thumbscrew 36, which extends through clamp ring 34 and through stem 30 near the distal end thereof to clamp snake 28 tightly within stem 30, must be loosened to release snake 28 from its clamping effect. Although thumbscrew 36 is loosened somewhat, it will normally always be kept engaged to the extent necessary to keep clamp ring 34 in its position along stem 30. When the desired length is pulled out of shell 22, thumbscrew 36 is retightened.

Then, the operator grips handle 32 and turns plastic shell 22, and with it stem 30, clamp ring 34, thumbscrew 36, and snake 28, such that snake 28 can operate to clean the inside of a clogged pipe. The turning of plastic shell 22 is facilitated by crank grip 58, which is integrally formed with plastic subshell 26 and extends from plastic subshell 26 in a direction parallel to the axis of plastic shell 22, but at a position removed from such axis. The operator holds handle 32 in one hand and crank grip 58 in the other, and the entire drain-cleaning implement 20 rotates with respect to handle 32 which is held non-rotatably.

Subshells 24 and 26 are snapped together by means of four pairs of male and female mating means which are spaced at equal intervals around cylindrical sidewall 42, along abutting annular edges 48 and 50. The female mating means are slots 60 through plastic subshell 24. More specifically, slots 60 extend through minor portion 46 of cylindrical sidewall 42 in a direction parallel to abutting annular edge 48 and at positions closely spaced from abutting annular edge 48. Each slot 60 extends for approximately 30 degrees around the axis of plastic shell 22.

Each slot 60 has opposed parallel edges 62 and opposed semi-cylindrical ends 64. Thus, slots 60 have corner-free profiles, thereby to minimize points of structural weakness in the plastic structure.

Plastic subshell 26 has four inwardly-projecting sidewall portions 66 spaced at 90 degree intervals around inside surface 57 of major portion 44 of cylindrical sidewall 42. Inwardly-projecting sidewall portions 66 extend in a direction generally parallel to the axis of plastic shell 22 and extend beyond abutting annular edge 50 of plastic subshell 26 to projection ends 68 adjacent to each of the slots 60. On each projection end 68 is a radially outwardly-facing elongated protuberance 70 shaped to be received within a slot 60.

Each of the elongated protuberances 70 have parallel opposite edges 72 and semi-cylindrical ends 74. Thus, four elongated protuberances 70 on projections 68 may snap into engagement with the four slots 60. This is the means by which plastic subshells 24 and 26 are joined together, and such snap engagement is facilitated by means of the outward force applied by coiled snake 28 on inside surface 57 of cylindrical sidewall 42.

Inside surface 57 of plastic subshell 26 is formed in a manner presenting a substantially edge-free surface around inside surface 57 of subshell 26. The portions of inside surface 57 which are between inwardly-projecting sidewall portions 66 are at a longer-radius position with respect to the axis of plastic shell 22, and inwardly-projecting sidewall portions 66 are at a shorter radius position. The transitions from the longer-radius positions between inwardly-projecting sidewall portions 66 and the shorter-radius positions on inwardly-projecting sidewall portions 66 are smooth, such that there are no edges which can increase the possibility of fracturing of plastic subshell 24.

By virtue of such smooth-transitioning edge-free surface around the inside of plastic subshell 26, plastic subshell 26 is substantially strengthened. And, it is strengthened in a way which allows the outward force of coiled snake 28 to be effectively applied, particularly at the spaced positions where elongated protuberances 70 engage their respective slots 60.

Such outward force is most effectively applied by coiled snake 28 when, as illustrated in the drawings, inwardly-projecting sidewall portions 66 have progressively shorter radii at positions progressively closer to their centers. This allows maximum outward force to be applied by coiled snake 28 to assist most effectively in achieving full engagement of the mating means and in making the profile of the shell true round.

Described in other terms, inside surface 57 of plastic subshell 26 has a smoothly undulating annular profile which gradually extends alternately from a fixed radius at positions between inwardly-projecting sidewall portions 66 to shorter radii at positions on inwardly-projecting sidewall portions 66.

Stem 30 has a reduced diameter portion 76 at its distal end 56, which forms an outwardly-facing stop ledge 78. Handle 32 is rotatably mounted on stem 30 at a position thereon between proximal end 54 of stem 30 and stop ledge 78. During initial assembly, clamp ring 34 is slid over reduced diameter portion 76 until it engages stop ledge 78. Clamp ring 34 and reduced diameter portion 76 of stem 30 are then drilled and tapped with clamp ring 34 in such proper position, before thumbscrew 36 is inserted. This allows positive positioning of clamp ring 34 such that handle 32 will rotate properly without either binding or being too loose.

Plastic shell 22 is preferably made of high density polyethelene using known plastic-forming methods. By virtue of the configurations described herein, the wall thicknesses of plastic shell 22 can be minimized without unacceptable weaknesses of the type allowing likely fracturing when drain-cleaning implement 20 is accidentally dropped on hard floors or other hard surfaces. A variety of other plastic materials, well known in the art, can be used instead of high density polyethelene. And a number of changes in the shapes of the subshells are possible.

While the principles of this invention have been described in connection with specific embodiments, it should be understood clearly that these descriptions are made only by way of example and are not intended to limit the scope of the invention.

What is claimed:

1. In a drain-cleaning implement of the type having a snake-containing plastic shell made from two plastic subshells snapped together along a pair of abutting annular edges around a cylindrical shell sidewall, the improvement comprising:

one subshell having female mating mean along the abutting edges;

the other subshell having on its inside surface inwardly-projecting sidewall portions formed at intervals around such surface and extending beyond the abutting edges as projections with outwardly-facing male mating means thereon positioned to engage the female mating means;

the inside surface having substantially edge-free transitions between the inwardly-projecting sidewall portions and positions therebetween; and the snake being coiled within the shell and exerting radially-outward force by contact with the inwardly-projecting sidewall portions to assist in engagement of the mating means.

2. The implement of claim 1 wherein the inwardly-projecting sidewall portions have progressively shorter radii at positions progressively closer to their centers, whereby maximum outward force is applied thereon to assist in full engagement of the mating means and in making the shell round.

3. The implement of claim 1 wherein the inside surface of the other subshell has a smoothly undulating annular profile extending alternately from a first radius at positions between the inwardly-projecting sidewall portions gradually to shorter radii at positions on the inwardly-projecting sidewall portions.

4. The implement of claim 1 wherein there are at least three inwardly-projecting sidewall portions.

5. The implement of claim 1 wherein the female mating means comprise slots extending a given distance around the plastic shell and having corner-free profiles, thereby to minimize points of structural weakness.

6. The implement of claim 5 wherein the male mating means have corner-free configurations corresponding to the corner-free profiles.

7. The implement of claim 1 further comprising:

an endwall on one of the subshells with an axial opening therein;

an axial stem having a proximal end secured to the endwall around the opening and extending to a distal end;

the stem having a reduced diameter portion at the distal end to form a stop ledge near the distal end;

a handle rotatably mounted on the stem at a position thereon between the proximal end and the stop ledge;

the snake extending through the stem to a position beyond the distal end; and a clamp ring over the distal end and against the stop ledge including means to selectively engage the stem and the snake, the stop ledge being located for positive positioning of the clamp ring such that the handle will rotate properly without either binding or being too loose.

8. The implement of claim 7 wherein the female mating means comprise slots extending a given distance around the plastic shell and having corner-free profiles, thereby to minimize points of structural weakness.

9. The implement of claim 8 wherein the male mating means have corner-free configurations corresponding to the corner-free profiles.

10. In a drain-cleaning implement of the type having a plastic shell with two endwalls and a cylindrical sidewall and formed by two subshells with abutting annular edges around the sidewall, an axial opening in one endwall, mounting means and a rotatably-mounted handle thereon extending from the one endwall at the opening, a snake coiled within the shell exerting radial force on the inside surface of the sidewall and having a distal end extending through the opening and handle, female mating means in one subshell, and a plurality of inwardly-projecting sidewall portions formed at intervals around the inside surface on the other subshell and extending beyond the abutting edges as projections with outwardly facing male means positioned to engage the female means, the improvement comprising the inside surface of the other subshell presenting a substantially edge-free surface around such subshell, with smooth transitions from longer-radius positions between, to shorter-radius positions on, the inwardly-projecting sidewall portions.

11. The implement of claim 10 wherein the inwardly-projecting sidewall portions have progressively shorter radii at positions progressively closer to their centers, whereby maximum outward force is applied thereon to assist in full engagement of the mating means and in making the shell round.

12. The implement of claim 10 wherein the inside surface of the other subshell has a smoothly undulating annular profile extending alternately from a first radius at positions between the inwardly-projecting sidewall portions gradually to shorter radii at positions on the inwardly-projecting sidewall portions.

13. The implement of claim 10 wherein there are at least three inwardly-projecting sidewall portions.

14. The implement of claim 10 wherein the female mating means comprise slots extending a given distance around the plastic shell and having corner-free profiles, thereby to minimize points of structural weakness.

15. The implement of claim 14 wherein the male mating means have corner-free configurations corresponding to the corner-free profiles.

16. The implement of claim 10 further comprising:

the mounting means including an axial stem having a proximal end secured to the endwall around the opening and extending to a distal end;

the stem having a reduced diameter portion at the distal end to form a stop ledge near the distal end;

the handle being rotatably mounted on the stem at a position thereon between the proximal end and the stop ledge;

the snake extending through the stem to a position beyond the stem distal end; and a clamp ring over the distal end and against the stop ledge including means to selectively engage the stem and the snake, the stop ledge being located for positive positioning of the clamp ring such that the handle will rotate properly without either binding or being too loose.

17. The implement of claim 16 wherein the female mating means comprise slots extending a given distance around the plastic shell and having corner-free profiles, thereby to minimize points of structural weakness.

18. The implement of claim 17 wherein the male mating means have corner-free configurations corresponding to the corner-free profiles.

* * * * *

UNITED STATES PATENT AND TRADEMARK OFFICE

CERTIFICATE OF CORRECTION

PATENT NO. : 4,706,321

DATED : November 17, 1987

INVENTOR(S) : Paul S. Kaye

It is certified that error appears in the above-identified patent and that said Letters Patent is hereby corrected as shown below:

On the cover page, after "Attorney, Agent or Firm" delete "Peter N. Ltd. Jansson" and insert in its place --Peter N. Jansson, Ltd.--

In column 3, line 24, delete "a" and insert in its place --at--.

In column 6, line 63, delete "mean" and insert in its place --means--.

Signed and Sealed this

Twenty-ninth Day of March, 1988

*Attest:*

*Attesting Officer*

DONALD J. QUIGG

*Commissioner of Patents and Trademarks*